United States Patent [19]

Campbell et al.

[11] Patent Number: 4,991,265

[45] Date of Patent: Feb. 12, 1991

[54] CORD TIE DEVICE

[75] Inventors: Donald E. Campbell; Suzanne R. Darling; Kristian R. Darling, all of Reno, Nev.

[73] Assignee: Best Shot, Sparks, Nev.

[21] Appl. No.: 438,172

[22] Filed: Nov. 20, 1989

[51] Int. Cl.[5] ..... B65D 63/00; F16G 11/00

[52] U.S. Cl. ..... 24/16 PB; 24/129 R; 24/128

[58] Field of Search ..... 24/16 PB, 17 AP, 17 A, 24/17 B, 30.5 P, 115 H, 115 M, 128

[56] References Cited

U.S. PATENT DOCUMENTS

| | | | |
|---|---|---|---|
| 370,239 | 9/1887 | Brombacher | 24/128 R |
| 2,592,696 | 4/1952 | Hoody | 24/129 R |
| 3,147,522 | 9/1964 | Schumm | 24/30.5 P |
| 3,422,499 | 1/1969 | Merser | 24/16 PB |
| 3,597,803 | 8/1971 | Van Neil | 24/16 PB |
| 3,837,047 | 9/1974 | Bunnell | 24/16 PB |
| 4,001,919 | 1/1977 | Moberg et al. | 24/16 PB |
| 4,558,495 | 12/1985 | Olsen | 24/16 PB |

FOREIGN PATENT DOCUMENTS

| | | | |
|---|---|---|---|
| 1254375 | 1/1961 | France | 24/16 PB |

*Primary Examiner*—Victor N. Sakran

*Attorney, Agent, or Firm*—Kelly Bauersfeld & Lowry

[57] ABSTRACT

An improved cord tie device is provided for use in wrapping and storing a coiled electrical power cord or the like. The cord tie device has a substantially unitary construction to include an elongated tie strap having a plurality of resilient strap segments interconnected by a plurality of enlarged and relatively stiff locking disks at spaced intervals along the strap length, and a slotted head forming a lock clasp at one end of the tie strap. The strap is adapted to loop snugly about a coiled electrical cord or the like, with one of the locking disks seated within and engaging the slotted head to retain the electrical cord in a neat stored configuration.

20 Claims, 1 Drawing Sheet

FIG. 1
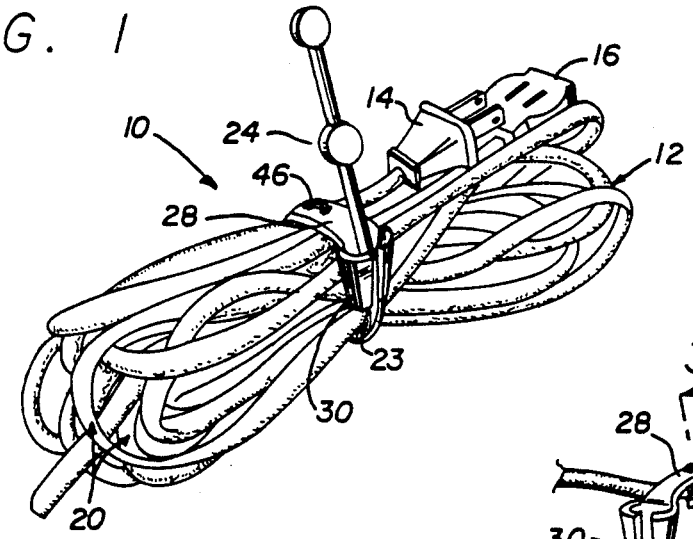
FIG. 2
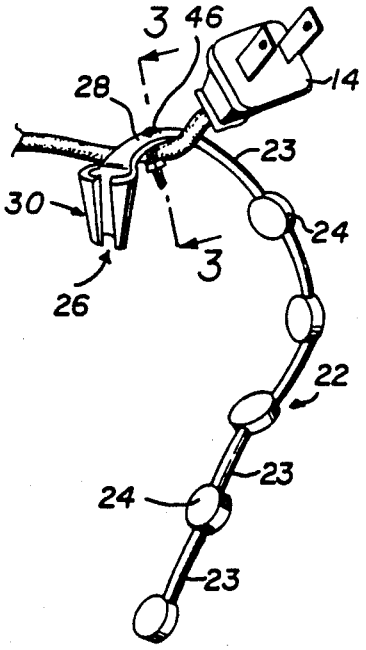
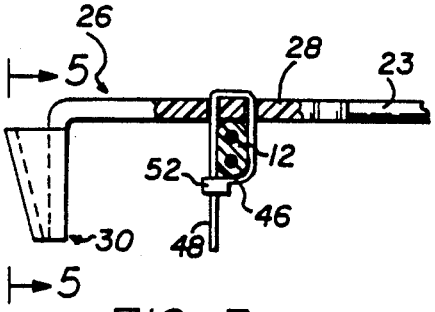
FIG. 3
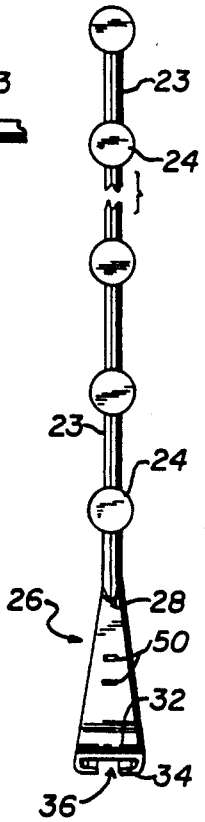
FIG. 6
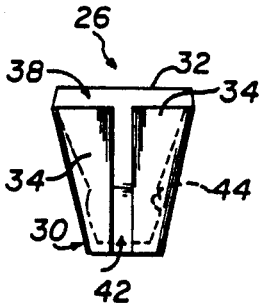
FIG. 5
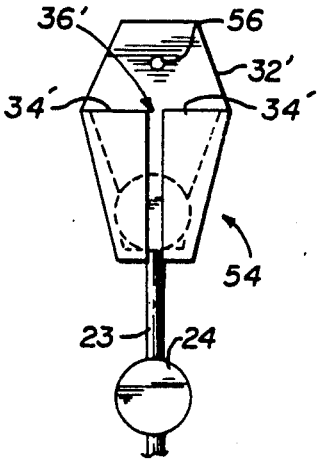
FIG. 4

CORD TIE DEVICE

BACKGROUND OF THE INVENTION

This invention relates generally to devices and systems for use in wrapping and neatly storing an electrical power cord or the like. More particularly, this invention relates to an improved cord tie device of relatively simple and easy-to-use construction, wherein the device can be employed for quickly and easily storing coiled electrical power cords of different sizes.

Electrically powered products such as appliances, tools, etc., are commonly equipped with an elongated power cord adapted for removable plug-in connection to an appropriate power source. In this regard, the power cord is typically provided with a sufficient length to accommodate anticipated normal use requirements, with the result that the cord has an unsightly excessive length which can become entangled is some applications. Moreover, when the electrical product is disconnected from a power source, difficulties are often encountered in wrapping the cord to a compact and neatly stored configuration ready for a subsequent use with minimum risk of cord entanglement. Alternately, although the cord might be neatly coiled for storage, unsatisfactory storage conditions often result in the cord becoming tangled prior to re-use of the electrical product. Similar problems arise with respect to electrical extension cords used to extend the length of a power cord for an electrical product.

In the past, a variety of devices have been proposed for use in retaining all or part of an electrical power cord in a neatly stored configuration. Such devices have included various tie strap structures designed to be tied about a coiled cord, particularly for maintaining a neat and attractive cord appearance when the electrical product is new. However, in general terms, these tie straps have been intended to be discarded when the electrical product is first used. Although some consumers have been known to retain such tie straps for subsequent re-use in wrapping and tying the power cord, the tie straps are not designed for repeated re-use and thus typically encounter structural failure after a small number of uses. Moreover, many prior tie straps are not designed for permanent attachment onto an associated power cord, such that the strap is physically separated from the power cord during normal use of the electrical product and thus easily becomes lost.

More recently, alternative cord tie products have been proposed specifically for repeated re-use in tying and storing of an electrical cord. Such products include, for example, a rigid base block having a beaded flexible strap connected thereto in a manner permitting the strap to be snugly wrapped about a coiled power cord and releasably interlocked with the base block. However, such device requires multiple components and further does not function satisfactorily with short cords having a coiled width significantly less than the span of the base block. To accommodate power cords of different lengths and cord sizes, it is necessary to produce the product in a range of base block sizes.

There exists, therefore, a need for further improvements in cord tie devices, particularly with respect to providing a versatile tie device formed substantially with a unitary construction and adapted for easy use in securely storing a coiled power cord of virtually any length or size. The present invention fulfills these needs and provides further related advantages.

SUMMARY OF THE INVENTION

In accordance with the invention, an improved cord tie device is provided for use in neatly tying and storing an electrical power cord or the like. The tie device has a substantially unitary construction and is designed for relatively simple use and repeated re-use for collecting and neatly storing an unused power cord, or excess length portions of a power cord in use.

In the preferred form of the invention, the cord tie device comprises an elongated tie strap formed from a flexible and somewhat resilient molded plastic to include a plurality of resilient strap segments interconnected by a plurality of relatively enlarged and stiff locking disks at spaced intervals along the strap length. At one end, the tie strap is joined integrally to a slotted head which has a lock clasp defining an open-ended pocket or cavity for receiving one of the locking disks. The thickness of the molded plastic material is increased at the head and at each disk, relative to the strap segments, such that the selected locking disk and head are relatively stiff for secure seated retention of the disk within the head pocket. Snap-fit detent tabs may be provided on the head for releasably locking with the locking disk. Moreover, in the preferred form, attachment means are included for attaching the cord tie device to an associated electrical power cord, such that the tie device will not become lost or separated from the cord when the tie device is not in use.

In use, the electrical power cord or portions thereof can be neatly coiled and shaped into a series of adjacent elongated loops to be held together in a compact storage configuration by wrapping the strap snugly about a central region of the cord loops. A selected one of the locking disks is drawn past the open-ended pocket of the lock clasp and seated into the pocket, with the specific locking disk being chosen to maintain the strap under at least some tension when said selected disk and head are engaged. In this configuration, the cord tie device maintains the power cord in a neatly stored or stowed geometry until a free end of the strap is pulled in an appropriate direction to withdraw and release the selected locking disk from the lock clasp.

In one embodiment of the invention, the cord tie device includes an auxiliary head fixture adapted for wall mounted attachment or the like in a convenient position, such as adjacent to an electrical power socket or the like. The auxiliary fixture also includes a lock clasp with an open-ended pocket for releasable reception of one of the locking disks on the strap. Accordingly, a power cord which has been tied for storage by means of the cord tie device may be conveniently stored on the auxiliary fixture by seating a locking disk on the free end of the strap into the fixture pocket.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a perspective view illustrating a cord tie device embodying the novel features of the invention, for use in securing an electrical power cord or the like in a stored configuration;

FIG. 2 is a fragmented perspective view showing attachment of the cord tie device to the electrical cord;

FIG. 3 is an enlarged sectional view taken generally on the line 3—3 of FIG. 2;

FIG. 4 is a fragmented plan view of the cord tie device;

FIG. 5 is an end view taken generally on the line 5—5 of FIG. 3; and

FIG. 6 is a fragmented elevational view showing a wall mount fixture for use with the invention.

DETAILED DESCRIPTION OF THE PREFERRED EMBODIMENT

As shown in the exemplary drawings, an improved cord tie device referred to in FIG. 1 by the reference numeral 10 is provided for convenient and easy use in neatly wrapping and storing an elongated electrical power cord 12 or the like. The cord tie device is substantially unitary in form and is adapted for repeated use in combination with power cords of different cord lengths and diametric sizes. The tie device maintains the stored power cord in a compact configuration without cord entanglement.

As shown in FIGS. 1 and 2, the cord tie device 10 of the present invention is designed for use with a conventional power cord 12 of the type having a pronged plug 14 at one end thereof for plug-in connection to an appropriate electrical power source (not shown). In this regard, the cord tie device may be used with power cords of the type attached to virtually any kind of electrical product such as large or small appliances, tools, etc. Moreover, the tie device 10 may be used with extension cords used with such electrical products. Still further, although the invention will be described herein in conjunction with an electrical power cord, it will be understood that the tie device 10 can be used to wrap and store other elongated cord-like articles, such as rope lines and the like.

The illustrative power cord 12 shown in FIGS. 1 and 2 comprises an elongated dual conductor extension cord of the standard household type having the pronged plug 14 at one end and a socket fitting 16 at its opposite end. The length and diametric size of the cord 12 may vary widely in a typical household environment and in some cases will include a third ground conductor. When the power cord 12 is not in use, it is desirable to coil the cord into generally circular loops of approximately uniform size and then to manually draw together opposite sides of the loops to form adjacent elongated loops referenced by arrow 20 in FIG. 1. Alternately, when the power cord 12 is used in an environment such that excess cord length is present, the excess portion of the cord may be arranged in elongated loops in the manner described. The cord tie device 10 is designed to wrap quickly and easily about the looped cord and to releasably retain the cord in a neat and attractive configuration wherein risk of cord entanglement is minimized or substantially eliminated.

The cord tie device is constructed substantially as a unitary or one-piece component from a selected molded plastic or the like. In this regard, the localized thickness of the selected plastic material is varied to provide a combination of flexible components having sufficient resiliency to wrap snugly in a tensioned manner about the power cord 12, together with comparatively rigid interengageable locking components for releasably locking the tie device in place.

More specifically, the cord tie device 10 comprises an elongated and relatively flexible strap 22 formed as a succession of short strap segments 23 of round cross section interconnected end-to-end by a spaced lineage of generally circular and relatively flat locking disks 24. The locking disks 24 are sized and shaped to be significantly wider than the strap segments 23, and further in the preferred form to have disk thicknesses which exceed the diametric cross sectional size of the strap segments. With this construction, the device 10 can be made as a unitary structure with the strap segments 23 having significant flexibility and a substantial degree of longitudinal resiliency or elasticity, whereas the larger locking disks 24 are comparatively structurally stiff. The specific length of the strap segments 23 and the number and relative spacings of the locking disks 24 may vary, although a total strap length of about six to eight inches and a disk spacing of about one to one and one-half inch center-to-center is satisfactory for most household cord storage applications.

The elongated strap 22 is joined at one end thereof to a head 26 which provides a locking member interengageable with any selected one of the locking disks 24. More specifically, as shown best in FIGS. 2 and 3, the round strap segment 23 at one end of the strap 22 is joined integrally with a neck segment 28 extending as a generally triangular plate with increasing width in a direction away from the strap. At outboard end of the neck segment 28 is joined to a lock clasp 30 oriented in the preferred form to extend generally perpendicularly to the neck segment.

The lock clasp 30 of the head 26 includes a base plate 32 joined along opposite side edges to a pair of wing members 34 which are folded upwardly and inwardly toward each other in spaced relation with the base plate. These head components define an open-ended pocket or cavity 36 (FIG. 4) within the space between the base plate 32 and inwardly turned edges of the wing members 34, wherein this pocket 36 progressively narrows in width in a direction away from the neck segment 28. In particular, as viewed best in FIG. 5, the lock pocket 36 includes a relatively large width entrance end 38 sized for relatively easy slide-in reception of a locking disk 24, with the opposite or narrow end of the pocket 36 being substantially less than the width of a locking disk. Accordingly, a locking disk 24 may be inserted or removed from the pocket 36 only via the entrance end 38. Importantly, the structural stiffness of the entire lock clasp 30 is sufficient for rigid interfitting locked engagement with a locking disk 24. A central longitudinal slot 42 between the free edges of the wing members 34 conveniently permits passage of the strap segments 23 to avoid interference with the locking procedure. Moreover, as viewed in FIG. 5, the inboard side edges of the pocket 36 may include inwardly protruding detent tabs 44 for snap-fit reception of a locking disk 24.

The cord tie device 10 as described above is conveniently adapted for attachment directly onto the power cord 12, so that the tie device 10 will not become displaced or lost when not in use. The illustrative embodiment depicts (FIGS. 2 and 3) a cable tie 46 having a free end 48 looped through a pair of narrow slits 50 in the neck segment 28, and then looped about the power cord 12 before unidirectional locked passage through a socket end 52 of the cable tie. Alternatively, it will be understood that other types of connection devices may be used, such as clip-on structures which may be molded integrally with the neck segment 28, or with any other portion of the cord tie device.

In use, the cord tie device 10 remains connected to the power cord 12 during normal cord use, such as at a position near the pronged plug 14 (FIG. 2). When storage of the cord 12 is desired, the power cord is coiled in a conventional manner to form a series of adjacent loops which can be drawn manually to the elongated loop geometry shown in FIG. 1. In this configuration, the strap 22 can be wrapped quickly and easily about a central region of the cord loops with sufficient manual tension applied to the strap to draw a selected locking disk 24 at least slightly beyond the lock clasp 30 of the head 26. While the strap 22 is maintained under manual tension, the selected locking disk 24 can be seated into the lock pocket 36 via the entrance end 38 thereof. The strap 22 can then be released, leaving the portion of the strap wrapped about the cord under slight tension and a condition of slight elongation. This tension, which is supplemented by natural spring characteristics of the wrapped cord, serves to retain the selected locking disk 24 seated securely within the head clasp 30. The tie device thus retains the cord in a neatly wrapped condition pending re-use, with the right angle bend between the neck segment 28 and the lock clasp 30 permitting relatively snug retention of substantially any size or length cord. When re-use is desired, a free end of the strap extending beyond the head clasp 30 can be manually drawn to pull the disk 24 from the lock pocket 36.

FIG. 6 shows a wall mount fixture 54 which is structurally and functionally similar to the lock clasp 30 of the tie device 10 and may be used in conjunction therewith for conveniently supporting a wrapped and tied power cord. More particularly, the fixture 54 includes a base plate 32' in combination with opposed wing members 34' which cooperatively define a lock pocket or cavity 36', having a geometry corresponding with that previously described with respect to the lock clasp 30. An aperture 56 in the base plate 32' accommodates passage of a mounting screw (not shown) or the like to permit the fixture 54 to be mounted at a convenient location on a wall or the like, such as on or adjacent to an electrical wall socket, or adjacent to a tool bench, etc. A power cord 12 which has been wrapped and tied using the device 10 can be supported from the fixture 54 by insertion of another locking disk 24 on the strap 22 into the fixture pocket 36'. FIG. 6 shows the locking disk 24 at the tail end of the strap 22 seated within the fixture pocket. Of course, the tie device can be lifted from the fixture quickly and easily when re-use is desired.

A variety of further modifications and improvements to the cord tie device 10 of the present invention will be apparent to those persons skilled in the art. Accordingly, no limitation on the invention is intended by way of the foregoing description and accompanying drawings, except as set forth in the appended claims.

What is claimed is:

1. A cord tie device for retaining an elongated cord in a relatively neat and compact storage configuration, said tie device comprising:

an elongated strap including a plurality of relatively flexible and resilient strap segments separated by a plurality of enlarged and relatively stiff lock members; and a head at one end of said strap, said head having a base member joined to a pair of wing members projecting outwardly from said base member and being folded over said base member and extending toward each other in spaced relation with said base member and terminating in free ends spaced from each other to define a slot having sufficient width to receive one of said strap segments, said base member and said wing members cooperatively defining an open-ended lock pocket having a relatively wide open end for removable reception of a selected one of said lock members, said lock pocket defining a pocket profile narrowing from said open end to a size smaller than the profile of said one lock member, said one lock member being receivable into said lock pocket by drawing said strap under tension about the cord and seating said one lock member into said lock pocket said strap is maintained under tension, said open end of lock pocket opening in a direction generally toward said strap such that tension on said strap draws said one lock members into said lock pocket.

2. The cord tie device of claim 1 wherein said strap and said head are formed integrally.

3. The cord tie device of claim 2 wherein said strap and said head are formed from a molded plastic material.

4. The cord tie device of claim 1 further including means for attaching said tie device to the cord.

5. The cord tie device of claim 4 wherein said attaching means comprises a cable tie.

6. The cord tie device of claim 1 further including means for attaching said head to the cord.

7. The cord tie device of claim 1 wherein said head comprises a neck segment joined to said one end of said strap, and a lock clasp joined to said neck segment, said lock clasp defining said open-ended pocket.

8. The cord tie device of claim 7 wherein said lock clasp extends generally perpendicular to said neck segment.

9. The cord tie device of claim 8 wherein said lock members comprise locking disks each having a width and thickness greater than the cross sectional size of said strap segments.

10. The cord tie device of claim 1 further including detent tabs within said lock pocket for snap-fit engagement with said one lock member.

11. The cord tie device of claim 1 further including a mounting fixture adapted for mounting onto a wall and defining another open-ended lock pocket for removable reception of another one of said locking members.

12. The cord tie device of claim 1 wherein said strap segments have a generally round cross section.

13. A cord tie device for retaining an elongated cord in a relatively neat and compact storage configuration, said tie device comprising:

an elongated strap including a plurality of relatively flexible and resilient strap segments separated by a plurality of enlarged and relatively stiff lock members;

a head at one end of said strap, said head defining an open-ended lock pocket for removable reception of a selected one of said lock members, said one lock member being receivable into said lock pocket by drawing said strap under tension about the cord and seating said one lock member into said lock pocket while said strap is maintained under tension, said lock pocket opening in a direction generally toward said strap such that tension on said strap draws said one lock member into said lock pocket; and a mounting fixture adapted for mounting onto a wall and defining another open-ended lock pocket for removable reception of another one of said locking members.

14. A cord tie device for retaining an elongated cord in a relatively neat and compact storage configuration, said tie device comprising:

an elongated strap including a plurality of relatively flexible and resilient strap segments separated by a plurality of enlarged and relatively stiff lock members and adapted for attachment to a cord; and a mounting fixture having a base member joined to a pair of wing members projecting outwardly from said base member and being folded over said base member and extending toward each other in spaced relation with said base member and terminating in free ends spaced from each other to define a slot having sufficient width to receive one of said strap segments, said base member and said wing members cooperatively defining an open-ended lock pocket having a relatively wide open end for removable reception of a selected one of said lock members, said lock pocket defining a pocket profile narrowing from said open end to a size smaller than the profile of said one lock member, said one lock member being receivable into said lock pocket open end by drawing said strap under tension in a direction seating said one lock member into said lock pocket.

15. A cord tie device for retaining an elongated cord in a relatively neat and compact storage configuration, said tie device comprising:

an elongated strap including a plurality of relatively flexible and resilient strap segments separated by a plurality of relatively stiff locking disks, each of said locking disks having a diametric size substantially greater that the cross sectional size of said strap segments and a thickness at least slightly greater that the cross sectional size of said strap segments;

a neck segment disposed generally at one end of said strap; and a lock clasp joined to said neck segment at a position generally opposite to said strap and being oriented generally perpendicular to said neck segment, said lock clasp including a generally planar base plate joined along opposite side edges thereof to a pair of wing members folded over said base plate and extending toward each other in spaced relation with said base plate to define a generally disk-shaped lock pocket having a relatively wide open end for receiving a selected one of said locking disks, and defining a pocket profile which narrows from said open end to a size smaller than the profile of said one locking disk, said open end of said pocket being presented in a direction toward said neck segment, and said wing members having free ends spaced from each other to define a slot having sufficient width to receive one of said strap segments.

16. The cord tie device of claim 15 wherein said strap segments have a round cross section.

17. The cord tie device of claim 15 wherein said neck segment has a pair of narrow slits formed therein.

18. The cord tie device of claim 17 further including a cable tie received through said slits in said neck segment.

19. The cord tie device of claim 15 wherein said strap and said neck segment and said lock clasp are integrally formed.

20. The cord tie device of claim 15 further including a mounting fixture adapted for mounting onto a wall and defining another open-ended lock pocket for removable reception of another one of said locking disks.

* * * * *